US008353681B2

(12) United States Patent
Hinrichs et al.

(10) Patent No.: US 8,353,681 B2
(45) Date of Patent: Jan. 15, 2013

(54) COMPRESSOR HAVING A DRIVE MECHANISM AND A LUBRICANT SEPARATOR

(75) Inventors: Jan Hinrichs, Friedrichsdorf (DE); Thomas Di Vito, Wehrheim (DE)

(73) Assignee: Luk Fahrzeug-Hydraulik GmbH & Co. KG, Bad Homburg v.d.H (DE)

( * ) Notice: Subject to any disclaimer, the term of this patent is extended or adjusted under 35 U.S.C. 154(b) by 496 days.

(21) Appl. No.: 11/660,619

(22) PCT Filed: Aug. 5, 2005

(86) PCT No.: PCT/DE2005/001387

§ 371 (c)(1),
(2), (4) Date: Aug. 20, 2007

(87) PCT Pub. No.: WO2006/021180

PCT Pub. Date: Mar. 2, 2006

(65) Prior Publication Data

US 2008/0034783 A1 Feb. 14, 2008

(30) Foreign Application Priority Data

Aug. 24, 2004 (DE) ..... 10 2004 040 825

(51) Int. Cl.
*F04B 1/26* (2006.01)

(52) U.S. Cl. ..... 417/270; 417/222.2; 417/313

(58) Field of Classification Search ..... 417/222.2, 417/269, 270, 313; 96/155, 204, 206, 208–209, 96/216

See application file for complete search history.

(56) References Cited

U.S. PATENT DOCUMENTS

| | | | | |
|---|---|---|---|---|
| 5,577,894 | A * | 11/1996 | Kawaguchi et al. | 417/222.2 |
| 5,733,107 | A * | 3/1998 | Ikeda et al. | 417/312 |
| 5,797,730 | A * | 8/1998 | Kawaguchi et al. | 417/222.2 |
| 5,988,990 | A * | 11/1999 | Lee | 417/312 |
| 6,010,314 | A * | 1/2000 | Kobayashi et al. | 417/222.2 |
| 6,152,713 | A * | 11/2000 | Hisanaga et al. | 418/55.2 |
| 6,203,284 | B1 * | 3/2001 | Kawaguchi et al. | 417/222.2 |
| 6,435,848 | B1 * | 8/2002 | Minami et al. | 417/440 |
| 6,511,297 | B2 * | 1/2003 | Ota et al. | 417/222.2 |
| 6,511,530 | B2 * | 1/2003 | Iwanami et al. | 96/189 |
| 7,413,422 | B2 * | 8/2008 | Ito | 418/55.6 |
| 7,972,119 | B2 * | 7/2011 | Ozeki et al. | 417/269 |
| 8,092,200 | B2 * | 1/2012 | Iijima et al. | 418/97 |
| 8,241,012 | B2 * | 8/2012 | Inoue et al. | 417/269 |
| 2005/0053480 | A1 * | 3/2005 | Murakami et al. | 417/313 |
| 2005/0069423 | A1 * | 3/2005 | Ebara et al. | 417/313 |
| 2005/0129536 | A1 * | 6/2005 | Ohtake | 417/313 |

(Continued)

FOREIGN PATENT DOCUMENTS

DE 101 56 785 6/2002

(Continued)

*Primary Examiner* — Devon Kramer
*Assistant Examiner* — Ryan Gatzemeyer
(74) *Attorney, Agent, or Firm* — Davidson, Davidson & Kappel, LLC

(57) ABSTRACT

A compressor, such as an air-conditioning compressor for motor vehicles, particularly with a drive which has an adjustable swept volume, for the intake and compression of a refrigerant and a lubricant separator, which separates lubricant from the refrigerant, in particular, in the discharge pressure region of the compressor. The lubricant is introduced to the drive by a partial flow branching off from the high pressure refrigerant flow.

13 Claims, 1 Drawing Sheet

U.S. PATENT DOCUMENTS

2005/0169769 A1* 8/2005 Kanai ..... 417/269
2007/0140870 A1* 6/2007 Fukanuma et al. ..... 417/269
2007/0177988 A1* 8/2007 Inoue et al. ..... 417/269
2009/0000872 A1* 1/2009 Yokoyama ..... 184/6.16
2009/0142202 A1* 6/2009 Inoue et al. ..... 417/313
2012/0213648 A1* 8/2012 Nakashima et al. ..... 417/313

FOREIGN PATENT DOCUMENTS

JP 10-311277 11/1998

* cited by examiner

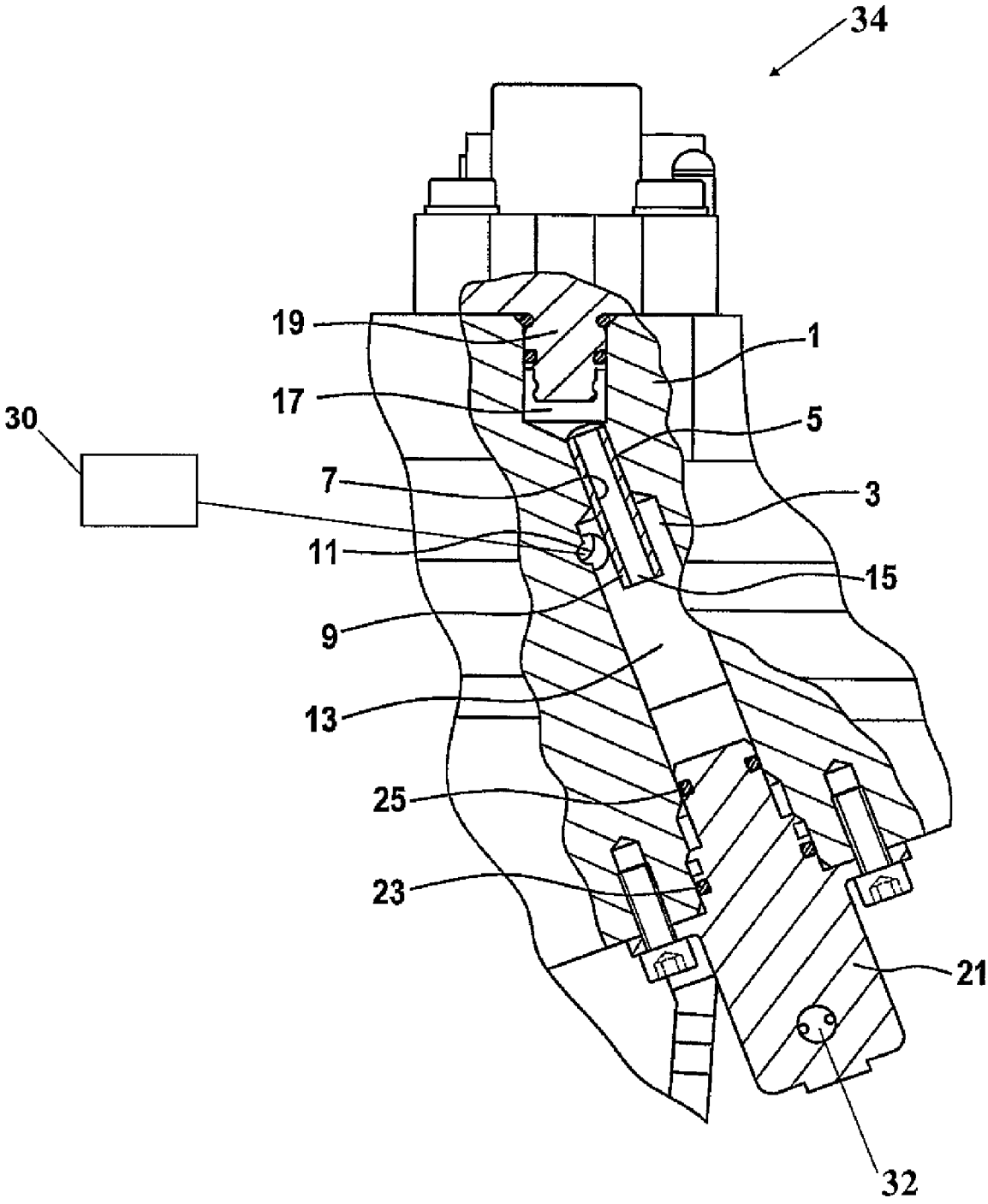
34
19
1
17
5
30
7
3
11
15
9
13
25
23
21
32

COMPRESSOR HAVING A DRIVE MECHANISM AND A LUBRICANT SEPARATOR

The present invention relates to a compressor, such as an air-conditioning compressor for motor vehicles, having a drive mechanism for the intake and compression of a refrigerant, and having a lubricant separator which separates lubricant from the refrigerant in the discharge pressure region of the compressor, the lubricant being supplied to the drive mechanism via a substream branched off from the high-pressure refrigerant stream.

BACKGROUND

Such lubricant separators are known. For example, there are lubricant separators which are mounted through a borehole in the discharge pressure connection. This results, for example, in a large borehole diameter for the high pressure/discharge pressure connection, and therefore requires a large external installation space in the region of the connection. There are also lubricant separators, characterized by multistage inserts having various diameters, which are inserted into a corresponding borehole. This design also entails a high level of complexity with respect to materials and installation space.

SUMMARY OF THE INVENTION

The object of the present invention, therefore, is to provide a compressor which does not have these disadvantages.

This objective is achieved by a compressor, such as an air-conditioning compressor for motor vehicles, having a drive mechanism for the intake and compression of a refrigerant, and having a lubricant separator which separates lubricant from the refrigerant in the discharge pressure region of the compressor, the lubricant being supplied to the drive mechanism via a substream branched off from the high-pressure refrigerant stream, and according to the present invention the compressor in the discharge pressure region having a stepped borehole, having a small diameter and a large diameter, in a housing component, and having a sleeve which is inserted into the small diameter and partially projects into the portion of the stepped borehole having the large diameter.

This has the advantage that a simple sleeve having a single diameter may be used as an insert, and only the borehole in the corresponding housing component of the compressor is stepped, it being easier to produce a borehole than to provide an outer diameter in a turned part, as in the related art.

A compressor is preferred in which a borehole opens into the stepped borehole in the region formed by the large diameter and the inwardly projecting sleeve, tangential to the outer circumference of the borehole wall having the large diameter, from the directly adjoining discharge pressure region of the cylinder head.

Furthermore, a compressor is preferred in which the stepped borehole is introduced as a separate borehole, essentially radially from the outside, into the cylinder head. Thus, the stepped borehole is not provided axially from the inside as in the related art, i.e., starting from the pressure chamber for the cylinder head, so that according to the present invention the sleeve may also be advantageously installed after the cylinder head is installed.

A compressor according to the present invention is characterized in that the stepped borehole also accommodates a valve which closes the borehole and thus seals the borehole from the outside.

This has the advantage that it is not necessary to seal the stepped borehole by use of a separate closure component.

Also preferred is a compressor in which the valve is a control valve which regulates the branched substream from the discharge pressure region to the drive chamber, and thus also regulates the drive chamber pressure.

This has the advantage that the lubricant is conveyed directly and without deviations into the control valve for the drive chamber pressure, and is not able to deposit beforehand at any deviations in the line.

Also preferred is a compressor in which the valve is a pressure relief valve which allows a discharge pressure stream to enter the drive chamber when a maximum pressure is exceeded.

A compressor according to the present invention is characterized in that the region of the stepped borehole having the small diameter opens into a second borehole which represents the outlet connection for the discharge pressure region of the refrigerant. This has the advantage that the diameter of the outlet connection may be kept very small in the discharge pressure region of the refrigerant, so that the external connections for the compressor do not occupy a large space.

Also preferred is a compressor in which the sleeve may be installed in the small-diameter region of the stepped borehole by pressing in from the valve side. This has the advantage that after installation of the compressor, i.e., with the cylinder head already mounted, the lubricant separator may be inserted by pressing in the sleeve before introducing the valve, and is also accessible later, after the compressor is installed, simply by removing the valve.

Also preferred is a compressor in which the diameter of the outlet connection for the discharge pressure region of the refrigerant may be kept very small, preferably in a range of 5 mm to 7 mm.

BRIEF DESCRIPTION OF THE DRAWINGS

The present invention is described with reference to the drawing.

DETAILED DESCRIPTION

The sole FIGURE shows a cross section of a compressor component together with the lubricant separator according to the present invention. A portion of compressor component 1, for example a section through the cylinder head of a compressor, is illustrated in a sectional view. Compressor component 1 has a drive mechanism 30 for intake and compression. In this compressor component 1 a stepped borehole having a large diameter 3 and a smaller diameter 5 is illustrated in a sectional view. A sleeve 7 which may be fastened in the stepped borehole by use of fastening techniques such as pressing, gluing, screwing, or the like is inserted in portion 5 of the stepped borehole having the smaller diameter. A portion 9 of sleeve 7 projects into the region of the stepped borehole having larger diameter 3 and together with the stepped borehole thus represents a double-walled cylindrical body in this segment.

Opening tangentially into the wall region between large diameter 3 of the stepped borehole and the outer diameter of sleeve segment 9 is an opening 11 which emerges from the outlet pressure region inside the cylinder head 34 of the air-conditioning compressor, in such a way that the refrigerant under high pressure may flow tangentially into this region. Since the refrigerant flowing tangentially through opening 11 also contains lubricant for lubricating the compressor, a helical motion of the lubricant results around the sleeve in the region of segment 9, in such a way that as the result of centrifugal force the lubricant is able to deposit externally on the wall of large stepped borehole diameter 3 and be conveyed downward into region 13 of the stepped borehole. The refrigerant itself flows inwardly through the sleeve in region 15 into region 17, which represents the outlet region of the compressor. A connecting component 19 which provides a line connection between the air conditioner and the air-conditioning compressor illustrated here is illustrated in outlet region 17 of the compressor. Illustrated in a sectional view in lower region 13 of larger-diameter region 3 of the stepped borehole is a valve body 21 which represents a control valve for regulating the drive chamber pressure. Lubricant is supplied to the drive mechanism 30 via a substream 32 branched off from the high pressure refrigerant. Since this control valve conducts a portion of the refrigerant stream directly into the drive chamber and therefore also conducts the main portion of the lubricant which has deposited at this location in the lubricant separator according to the present invention, the drive chamber is thus supplied with the appropriate lubricant via the shortest path, whereas the refrigerant which is to a large extent separated from the lubricant is fed, in a main stream through interior 15 of sleeve 7, to outlet 17 for the air conditioner. Control valve 21 has sealing rings 23 and 25 and thus simultaneously seals the stepped borehole in the lubricant separator.

The design of the lubricant separator illustrated here differs from the lubricant separators known from the related art in particular by the fact that a very economical manufacturing method may be provided by use of a single stepped borehole, and the function of the lubricant separator may then be implemented in a simple, quick, and economical manner by use of a very simple component such as sleeve 7 without, for example, stepped turned parts or similar components taking over the function of the lubricant separator as in the related art.

LIST OF REFERENCE NUMERALS

1 Compressor component
3 Large diameter
5 Small diameter
7 Sleeve
9 Sleeve segment
11 Opening from the outlet pressure region
13 Region of the stepped borehole
15 Inlet region of the sleeve
17 Outlet pressure region
19 Air conditioner connecting component
21 Valve body
23 Sealing ring
25 Sealing ring

What is claimed is:

1. A compressor comprising: a drive chamber for the intake and compression of a refrigerant; a lubricant separator separating lubricant from the refrigerant in a discharge pressure region of the compressor, the lubricant being supplied to the drive chamber via a substream branched off from a high-pressure refrigerant stream, the lubricant separator including: a compressor component in the discharge pressure region having a stepped borehole defining a smaller diameter and a larger diameter, the larger diameter having an upper region and a lower region, the stepped borehole defining a separating region for separating the lubricant from the refrigerant; a sleeve inserted in the smaller diameter and partially projecting into the upper region of the stepped borehole having the larger diameter, the sleeve having a constant diameter along an axial length of the sleeve; and a valve, the valve being in a lower region of the larger diameter and not contacting the sleeve, the valve permitting the lubricant to be supplied directly to the drive chamber via the substream so as to regulate a pressure in the drive chamber.

2. The compressor as recited in claim 1 wherein a further borehole opens into the portion of the stepped borehole between the large diameter and the inwardly projecting sleeve, the further borehole being tangential to an outer circumference of a wall of the stepped borehole having the larger diameter.

3. The compressor as recited in claim 1 wherein the stepped borehole is separate from a cylinder head of the compressor, the stepped bore hole being radially introduced into the compressor component from a valve side of the stepped borehole into an inside of the compressor component.

4. The compressor as recited in claim 1 wherein the valve closes the stepped borehole to seal the borehole from the drive chamber.

5. The compressor as recited in claim 4 wherein the valve is a control valve regulating the substream from the discharge pressure region into the drive chamber.

6. The compressor as recited in claim 4 wherein the valve is a pressure relief valve regulating the substream from the discharge pressure region into the drive chamber when a maximum allowable pressure is exceeded.

7. The compressor as recited in claim 1 wherein the region of the stepped borehole having the smaller diameter opens into a second borehole, the second borehole being an outlet connection for refrigerant in the discharge pressure region.

8. The compressor as recited in claim 1 wherein the sleeve is capable of being installed in the smaller diameter region of the stepped borehole from a valve side of the stepped borehole.

9. The compressor as recited in claim 7 wherein a diameter of the outlet connection for refrigerant in the discharge pressure region is in a range of 5 mm to 7 mm.

10. The compressor as recited in claim 7 wherein the compressor is an air-conditioning compressor for motor vehicles.

11. A compressor comprising: a drive chamber for the intake and compression of a refrigerant; a lubricant separator separating lubricant from the refrigerant in a discharge pressure region of the compressor, the lubricant separator including: a compressor component in the discharge pressure region having a stepped borehole defining a smaller diameter and a larger diameter, the larger diameter having an upper region and a lower region; a sleeve being held by the smaller diameter and partially projecting into the upper region of the stepped borehole having the larger diameter; and a valve, the valve closing the lower region of the larger diameter and being spaced from the sleeve, the valve including a hole therein permitting the lubricant to be supplied therethrough, the lubricant being supplied via a substream branched off from a high pressure refrigerant stream.

12. The compressor as recited in claim 11 wherein the borehole is cylindrically shaped at the larger diameter.

13. The compressor as recited in claim 11 wherein the sleeve has a constant diameter along an axial length of the sleeve.

* * * * *